US008336524B2

(12) United States Patent
Ganser et al.

(10) Patent No.: US 8,336,524 B2
(45) Date of Patent: Dec. 25, 2012

(54) FUEL INJECTION DEVICE

(75) Inventors: Marco Ganser, Oberägerl (CH); Ulrich Moser, Rickenbach-Attikon (CH)

(73) Assignee: Ganser-Hydromag AG, Oberageri (CH)

( * ) Notice: Subject to any disclaimer, the term of this patent is extended or adjusted under 35 U.S.C. 154(b) by 332 days.

(21) Appl. No.: 12/677,522

(22) PCT Filed: Sep. 5, 2008

(86) PCT No.: PCT/CH2008/000375
§ 371 (c)(1),
(2), (4) Date: Mar. 10, 2010

(87) PCT Pub. No.: WO2009/033304
PCT Pub. Date: Mar. 19, 2009

(65) Prior Publication Data

US 2010/0170476 A1 Jul. 8, 2010

(30) Foreign Application Priority Data

Sep. 13, 2007 (CH) ..... 1428/07

(51) Int. Cl.
*F02M 55/02* (2006.01)
*F02M 55/04* (2006.01)

(52) U.S. Cl. ..... 123/469; 123/456

(58) Field of Classification Search ..... 123/467, 123/468, 469, 456, 447; 239/88–91, 533.2–533.12; 701/103
See application file for complete search history.

(56) References Cited

U.S. PATENT DOCUMENTS

| | | | | |
|---|---|---|---|---|
| 3,788,546 | A * | 1/1974 | Bailey et al. | 239/120 |
| 4,071,197 | A * | 1/1978 | Bailey et al. | 239/533.11 |
| 4,111,370 | A | 9/1978 | Chelgren | |
| 4,197,996 | A * | 4/1980 | Giardini | 239/87 |
| 4,601,269 | A * | 7/1986 | Kato et al. | 123/300 |
| 5,497,750 | A | 3/1996 | Mueller et al. | |
| 5,692,476 | A | 12/1997 | Egler et al. | |
| 6,116,273 | A * | 9/2000 | Tarr et al. | 137/539 |
| 2002/0092936 | A1 | 7/2002 | Ricco | |
| 2003/0217726 | A1 * | 11/2003 | Kennedy et al. | 123/198 D |
| 2004/0251322 | A1 | 12/2004 | O'Brien et al. | |
| 2008/0184962 | A1 | 8/2008 | Pauer | |

(Continued)

FOREIGN PATENT DOCUMENTS

DE 43 41 543 8/1995

(Continued)

OTHER PUBLICATIONS

International Preliminary Report on Patentability of International Application No. PCT/CH2008/000375, mailed Apr. 7, 2010.

(Continued)

*Primary Examiner* — Mahmoud Gimie
(74) *Attorney, Agent, or Firm* — Hershkovitz & Associates, LLC; Abe Hershkovitz

(57) ABSTRACT

The invention relates to an injection device for injecting high-pressure fuel into the combustion chamber of an internal combustion engine, the device comprising an injection valve assigned to a discrete reservoir chamber. A non-return valve operates between the chamber and the high-pressure supply line and the filter, which is preferably designed as an edge filter, forms a stop for limiting the opening motion of the valve member that is preferably designed as a valve member plate.

15 Claims, 9 Drawing Sheets

U.S. PATENT DOCUMENTS

2008/0296413 A1 12/2008 Ganser

FOREIGN PATENT DOCUMENTS

| | | | |
|---|---|---|---|
| DE | 101 14 219 | | 9/2002 |
| DE | 10 2004 055 266 | | 5/2006 |
| DE | 10 2005 012 928 | | 9/2006 |
| EP | 0 921 303 | | 6/1999 |
| EP | 1 108 886 | | 6/2001 |
| EP | 1 223 335 | | 7/2002 |
| EP | 1 353 063 | | 10/2003 |
| EP | 1 485 609 | | 12/2004 |
| GB | 2 341 637 | | 3/2000 |
| JP | 2000-205081 | | 7/2000 |
| JP | 2001003833 A | * | 1/2001 |
| WO | WO 03/027485 | | 4/2003 |
| WO | WO 03/076794 | | 9/2003 |
| WO | WO 2007/009279 | | 1/2007 |

OTHER PUBLICATIONS

International Search Report and Annex of International Application No. PCT/CH2008/000375, mailed Jan. 30, 2009.

* cited by examiner

FUEL INJECTION DEVICE

CROSS-REFERENCE TO RELATED APPLICATIONS

The present application is a national stage application under 35 U.S.C. §371 of International Application No. PCT/CH2008/000375 with an international filing date of Sep. 5, 2008, and claims priority to CH 01428/07 filed Sep. 13, 2007. The present invention relates to a device for injecting highly pressurized fuel into a combustion chamber in an internal combustion engine.

BACKGROUND OF THE INVENTION

A device of said type is known from WO 2007/009279 A1. In said known high-pressure accumulator injection system for an internal combustion engine, each injection valve is assigned an accumulator chamber and a non-return valve with bypass throttle connected parallel thereto. The injection valves are connected by means of fuel lines to a high-pressure feed device. By virtue of each injection valve being assigned a non-return valve with bypass throttle connected parallel thereto, it is possible with said high-pressure accumulator injection system to realize stable and reproducible injection processes with an expedient pressure profile during every injection process, even if the discrete accumulator chambers have an unusually small volume. Said high-pressure accumulator injection system makes do without a large-volume common rail.

A further injection device is known from EP 1 108 886 A. The cylinder head of an internal combustion engine has inserted into it one injection valve for each combustion chamber. A bore runs through the cylinder head to each injection valve, in which bore is laid a pressure pipe. The housing of the injection valve has, at the side, a high-pressure sealing surface against which the pressure pipe bears by means of its high-pressure counterpart sealing surface integrally formed on the end at this side. The high-pressure supply line to each pressure pipe is formed by a single common rail which is fastened directly to the cylinder head by means of screws and brackets. The brackets form a structural unit with the common rail, which structural unit can be pressed for sealing against the pressure pipe by means of screws. A flow restrictor may be provided between the common rail and each pressure pipe, which flow restrictor is fastened to the common rail by means of a thread and bears, by means of its end facing away from the common rail, against the pressure pipe. The common rail, which forms the high-pressure supply line, forms an accumulator, which is common to all the injection valves, for the highly pressurized fuel. Common rails are dependent on the number of cylinders of the internal combustion engine, the configuration of the internal combustion engine and the power of the latter, and are therefore specific to every engine type.

To eliminate the associated disadvantages, it is proposed in EP 1 485 609 B1 that each injection valve, which has an accumulator chamber, have attached to it by means of a screw connection a tubular high-pressure connection piece which forms a further accumulator chamber. At the other side, the high-pressure connection piece is connected by means of a supply throttle to a duct for the fuel.

In a fuel injection system known from WO 03/027485 A1, a number of fuel injectors are charged with highly pressurized fuel by means of a high-pressure collecting chamber via high-pressure lines. The fuel injectors comprise an annular chamber into which a connection piece which holds the high-pressure line opens out. Held so as to be situated upstream of the injector as viewed in the flow direction, and assigned to the high-pressure supply line, is a secondary volume which comprises a hydraulic decoupling element at its side facing toward the distributor.

JP 2000-205081 A discloses an accumulator injection system in which fuel is supplied at high pressure to a common rail by means of a high-pressure pump. An auxiliary accumulator is connected between a distributor line, which is arranged downstream of the common rail, and a nozzle holder. The auxiliary accumulator has a capacity of 3 to 20 times the fuel quantity required for a full-load injection.

The fuel injection system known from DE 10 2004 055 266 A1 also provides, between a high-pressure fuel pump and the injectors, one pressure accumulator for each injector.

WO 03/076794 A1 discloses an injection system which has feed units for feeding fuel from a fuel reservoir for the supply of at least one high-pressure line to the cylinders of an internal combustion engine. A number of fuel injectors are supplied by means of the at least one high-pressure line, with said fuel injectors comprising line sections by means of which the individual fuel injectors are connected to one another. The injector bodies comprise an integrated accumulator chamber.

In the common rail injection system known from EP 0 921 303 A, the accumulator is connected directly by means of a bracket and a pressure pipe to the injector. Should relatively significant leakages occur in the injection system, a flow restrictor may be connected between the accumulator and bracket.

EP 1 353 063 A2 discloses a fuel injection system in which at least one injection nozzle, which is connected to a feed system, is provided for each cylinder of the internal combustion engine. The feed system has an associated fuel pressure accumulator for each cylinder.

The fuel injection system disclosed in DE 101 14 219 A1 for supplying fuel to the combustion chambers of an internal combustion engine has a high-pressure pump which charges a number of fuel injectors with highly pressurized fuel. The individual fuel injectors is assigned in each case an accumulator volume which is charged directly by the high-pressure pump via a high-pressure supply line.

SUMMARY OF THE INVENTION

Taking said prior art as a starting point, it is an object of the present invention to create a generic device which operates reliably while having a space-saving design.

Said object is achieved by means of a device having the features of the present invention.

A filter retains solid particles in the fuel, which prevents blockage of in particular narrow flow cross sections and therefore increases the reliability of the injection device. Since the filter also serves as a stop for limiting the opening movement of a valve member of a non-return valve, a particularly simple, space-saving design is possible.

Preferred embodiments of the device according to the invention are described in the present disclosure.

With the refinement of the injection device according to the present invention, it is possible in a simple manner for a further injection valve to be supplied with fuel. A supply line connection and a clamp may be arranged on a housing of the injection valve itself or of a pressure connector.

A device according to the present invention can be produced cheaply while being functionally reliable. As a result of the separation of the valve member into a plunger and a piston element, greater tolerances between the guide for the piston element and the seat for the plunger are admissible without reliability being impaired.

Optimum injection processes without a common rail are also made possible by means of an injection device in which a pressure connector assigned to an injection valve has an accumulator housing and a pressure pipe fastened to said accumulator housing for example by means of a screw connection. The accumulator housing is connected to a high-pressure supply line for the fuel and delimits a discrete accumulator chamber for the fuel.

The pressure connector forms a stable, self-supporting structural unit which can be pre-assembled. If the pressure connector has an accumulator housing and a pressure pipe fastened thereto by means of a screw connection, it is possible for the pressure chamber to be formed in a particularly simple manner.

Moreover, the formation of the device with a screw connection enables further components, such as a non-return valve, a filter, in particular edge-type filter, and a flow restricting valve to be installed into the pressure connector in a particularly simple manner.

The discrete accumulator chambers in the pressure connector permit optimum injection processes even if the high-pressure supply line has a small accumulator volume. It is possible for each injection valve itself to be provided with a further accumulator chamber.

With regard to the dimensioning of the accumulator chambers and the mode of operation of the accumulator chambers viewed together with the accumulator chambers, which are assigned to the other injection valves of the device, of the pressure connector in question, reference is made to WO 2007/009297 A. In terms of function, the discrete accumulator chambers described therein are identical in terms of effect to the accumulator chambers in the pressure connectors.

BRIEF DESCRIPTION OF THE DRAWINGS

The present invention will be described in more detail on the basis of exemplary embodiments illustrated in the drawing, in which, in each case purely schematically.

DETAILED DESCRIPTION OF THE INVENTION

Figure 1:
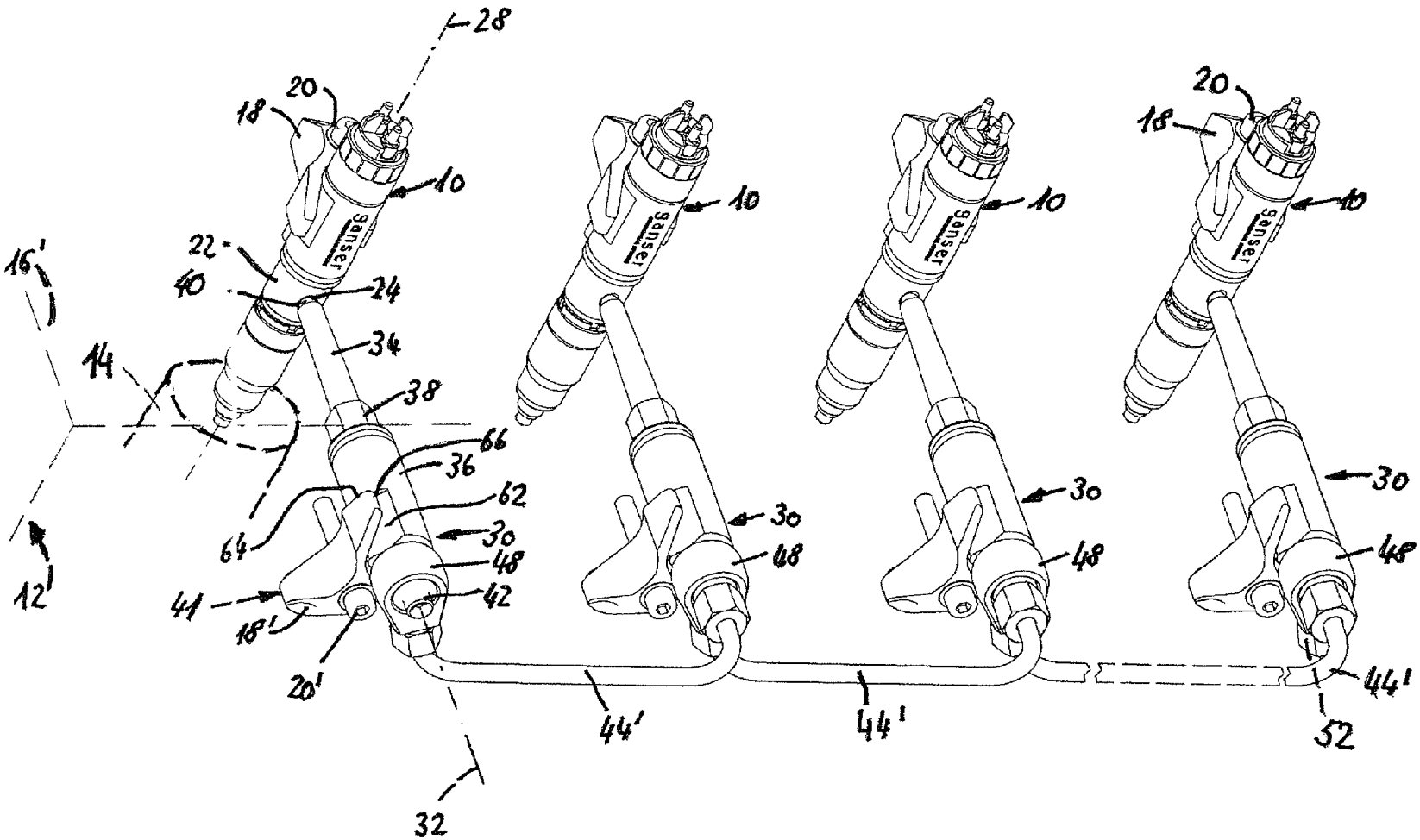
FIG. 1 shows a perspective illustration of four injection valves of a row of injection valves arranged in a cylinder head of an internal combustion engine, pressure connectors assigned to the injection valves and a high-pressure supply line for feeding fuel to the injection valves.

FIG. 1 shows the first three and the final one of a row of injection valves 10 of an internal combustion engine 12. Injection valves 10 of said type are generally known and are designed to intermittently inject very highly pressurized fuel into combustion chambers 14 of the internal combustion engine 12. The injection valves 10 are inserted into the cylinder head 16 of the internal combustion engine 12 and are fastened by means of clamping brackets 18 and clamping screws 20 to the cylinder head 16.

Figure 2:
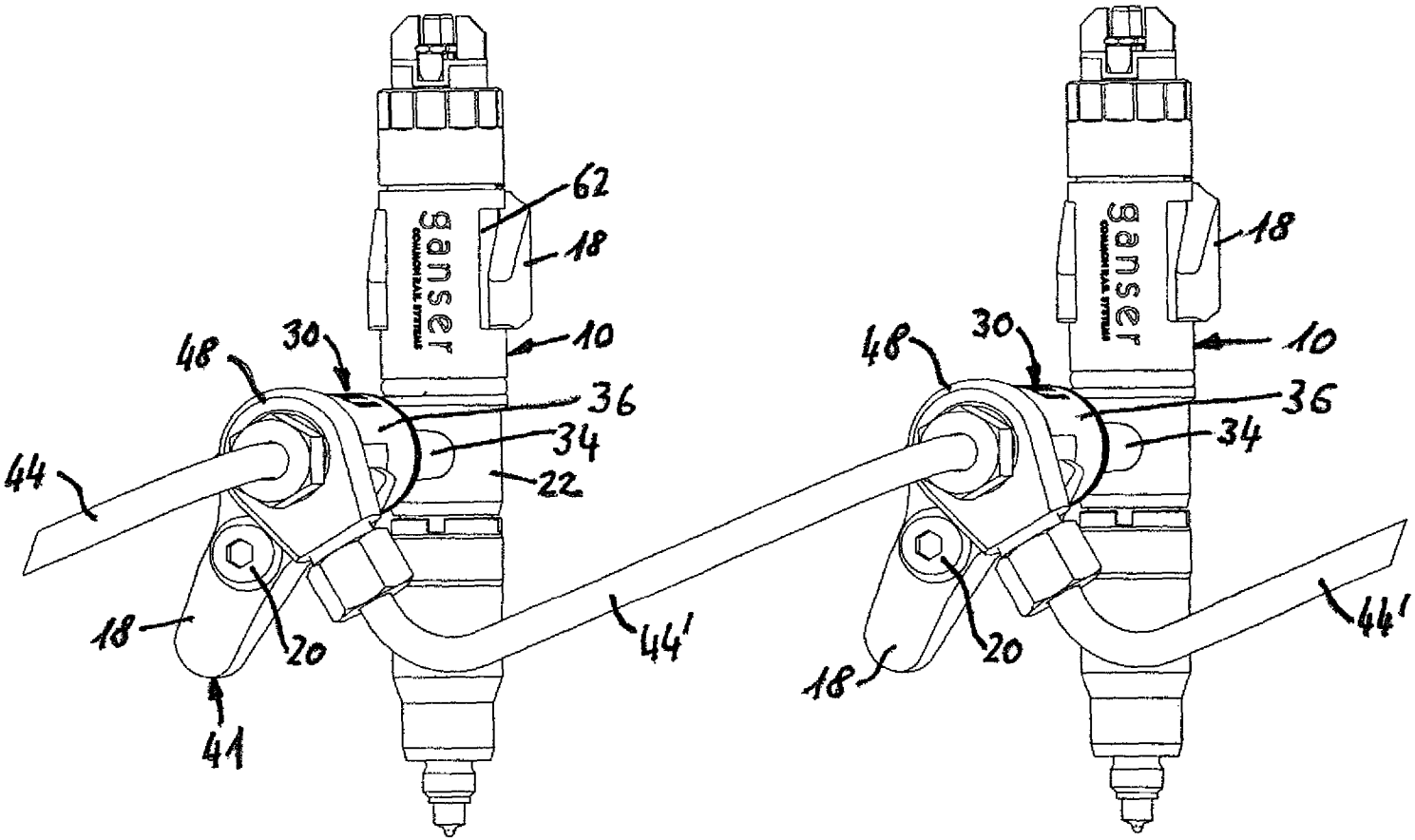
FIG. 2 shows, in a view, two of the injection valves shown in FIG. 1 with the associated pressure connectors and the high-pressure supply line.
Figure 3:
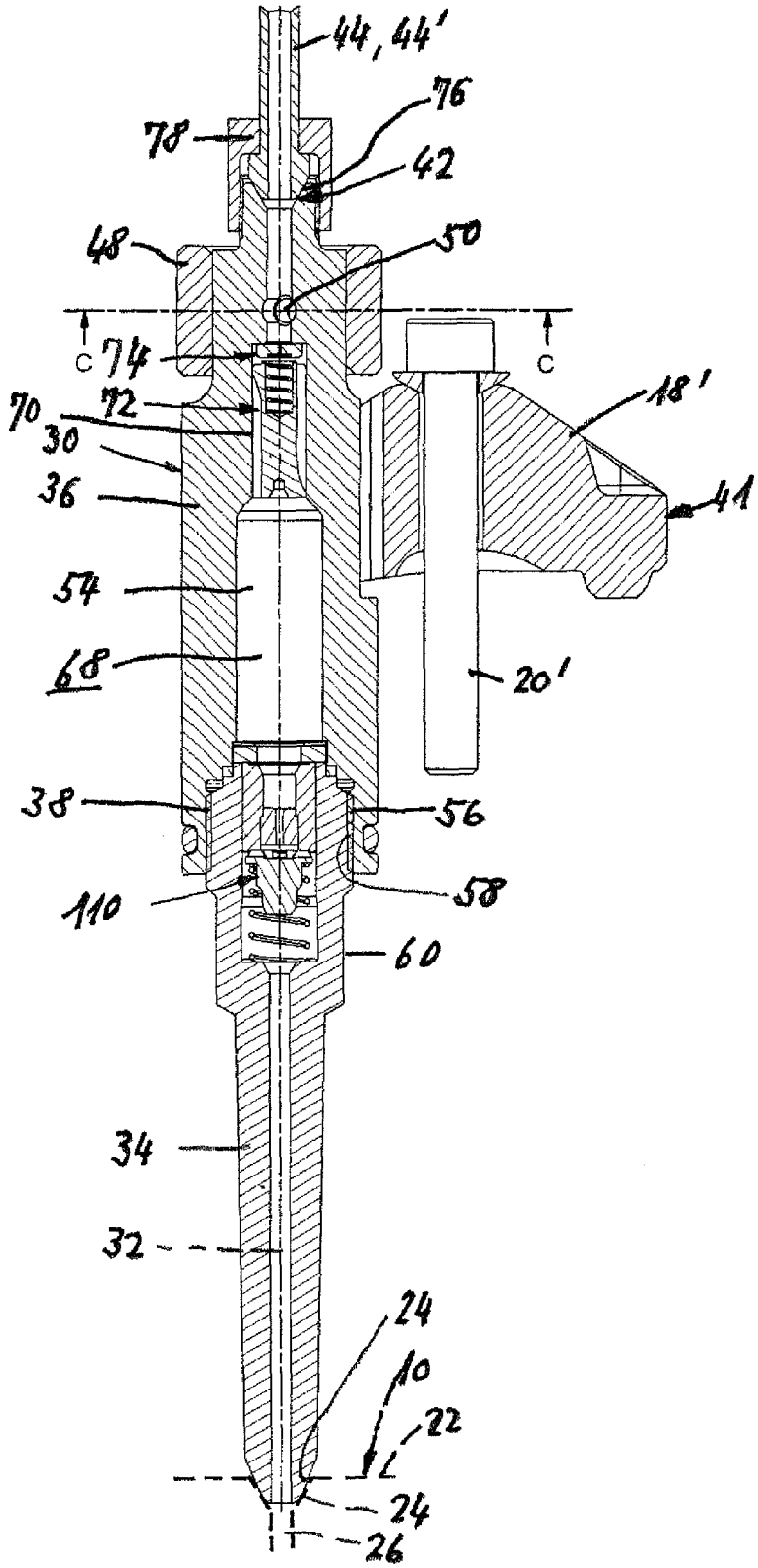
FIG. 3 shows a longitudinal section through a pressure connector, which has an accumulator housing and a pressure pipe, according to FIGS. 1 and 2, and a clamping bracket.

Each of the identically designed injection valves 10, which are also shown in FIG. 2, has an at least approximately cylindrical valve housing 22 whose housing body is provided, on its outer side, with an outwardly pointing high-pressure sealing surface 24 which surrounds a fuel inlet opening of the valve housing 22 (see also FIG. 3). The high-pressure sealing surface 24 which is formed on the valve housing 22 preferably tapers conically from the outside to the inside as viewed in the radial direction with respect to the longitudinal axis 28 of the injection valve 10.

As viewed in the direction of the longitudinal axis 28, the generally known injection valves 10 have firstly nozzle openings for injecting the fuel and secondly connections for the electrically controlled actuator and if appropriate the fuel return line. The actuator controls a hydraulic control device for intermittently injecting the fuel.

Each injection valve is assigned a pressure connector 30 whose longitudinal axis 32 runs preferably at least approximately, in the present case exactly perpendicular to the longitudinal axis 28 of the injection valve 10 and intersects said longitudinal axis 28. The pressure connectors 30 have in each case one pressure pipe 34 and one accumulator housing 36 which are fixedly connected to one another by means of a screw connection 38.

A preferably conical or spherical high-pressure counterpart sealing surface 40 is formed on the pressure pipe 34 at that free end region of the latter which faces away from the accumulator housing 36. The pressure pipe bears with its high-pressure counterpart sealing surface 40 against the high-pressure sealing surface 24 of the valve housing 22. If the high-pressure counterpart sealing surface 40 is formed so as to taper conically to the end of the pressure pipe 34 or spherical at the end, the pressure pipe 34 engages into the valve housing 22, which leads to automatic centering of the pressure pipe 34 with respect to the injection valve 10.

As indicated in FIG. 1, the pressure connectors 30 are inserted into the cylinder head 16 and, by means of further clamping brackets 18' and further clamping screws 20', are fastened to said cylinder head 16 and pressed in the direction of the injection valves 10 such that the high-pressure sealing surfaces 24 and high-pressure counterpart sealing surfaces 40 bear sealingly against one another. The further clamping brackets 18' and 20' form clamping devices 41 for the pressure connectors 30. The valve housing 22 and accumulator housing 36 are of identical design in the region of engagement of the clamping brackets 18 and 18', such that identical clamping brackets 18, 18' and clamping screws 20, 20' can be used to fasten the injection valves 10 and to fasten the pressure connectors 30.

The accumulator housings 36 have, at their free end facing away from the pressure pipe 34, a supply line connection 42 arranged concentrically with respect to the longitudinal axis 28. A high-pressure supply line 44, illustrated in FIG. 2, leads to the supply line connection 42 of the first injection valve 10. Said high-pressure supply line 44 is connected at the other end to a generally known high-pressure feed pump (not shown) which supplies very highly pressurized fuel, at a pressure of for example approximately 1600 to over 2000 bar, to the injection valves 10.

Adjacent to the supply line connection 42, each accumulator housing 36 is engaged around by a clamp 48. In the region of the clamp 48, each accumulator housing 36 has a radial connecting passage 50—see FIGS. 3 to 5—for the supply of fuel via a further high-pressure supply line 44' to the pressure connector 30 of the next injection valve 10. The connecting passage 50 of the pressure connector 30 assigned to the last of the row of injection valves 10 is sealingly closed off by means of a closure peg 52 inserted into the clamp 48. In this way, all the accumulator housings 36 and clamps 48 can be of identical design. If the internal combustion engine 12 is an in-line engine, then the respective further high-pressure supply lines 44' may if appropriate also be of identical design.

As is particularly clear from FIG. 3, a bore 54 runs through the substantially round cylindrical accumulator housing 36, which bore 54 widens multiple times from the supply line connection 42 to the pressure-pipe-side end. In an end region facing toward the pressure pipe 34, the bore 54 has its greatest diameter and is provided with an internal thread 56. The pressure pipe 34, which is provided in the end region at this side with an external thread 58, is screwed into the internal thread 56. To enable the screw connection 38 formed by the internal thread 56 and external thread 58 to be tightened, firstly the pressure pipe 34 has an external hexagon 60 for the engagement of a flat wrench and secondly the accumulator housing 36 has two parallel flattened portions 62 which serve for the engagement of a further flat wrench or for clamping into a clamping device (cf. FIGS. 1 and 2). The further clamping bracket 18' also engages into the recesses formed by said flattened portions 62, which further clamping bracket 18' interacts by means of its pressure shoulders 64 with counterpart shoulders 66 on the accumulator housing 36.

Figure 5:
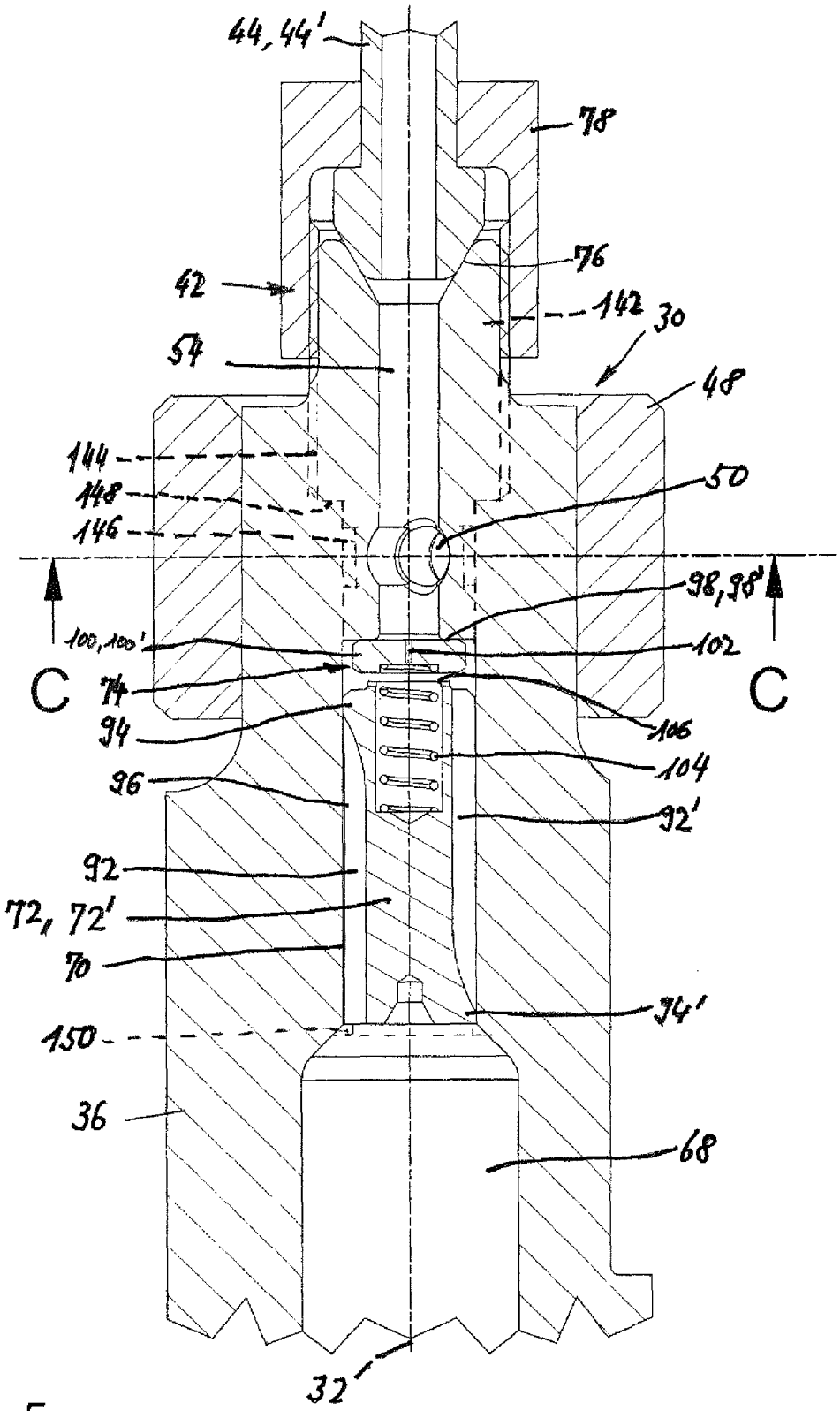
FIG. 5 shows a longitudinal section of a part of the accumulator housing with a non-return valve and edge-type filter arranged therein.
Figure 6:
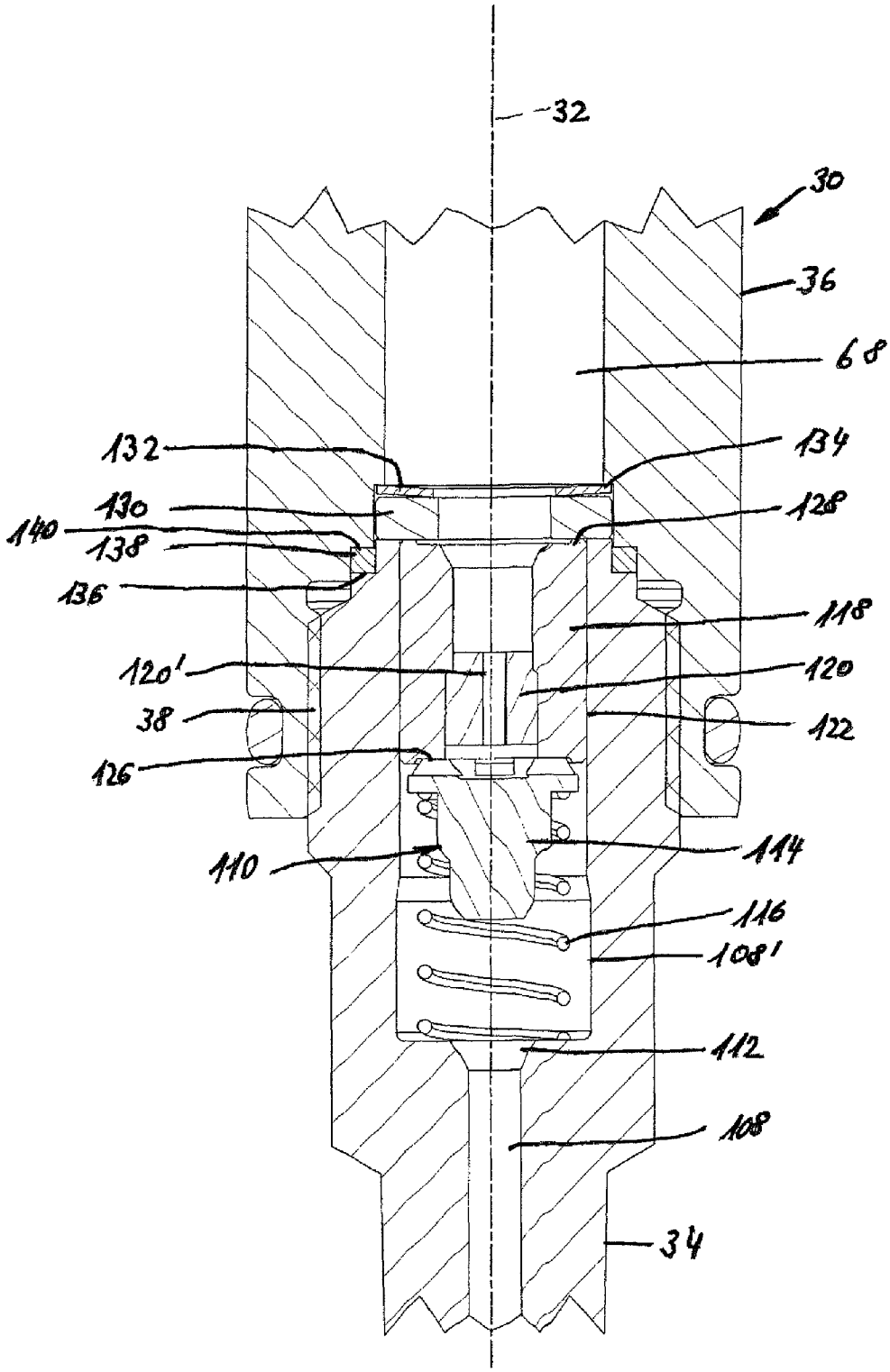
FIG. 6 shows, likewise in longitudinal section, a part of the accumulator housing and of the pressure pipe at the screw connection to a flow-restricting valve arranged therein.

Adjacent to the threaded section, the bore 54 narrows via two small shoulders—discussed in more detail in conjunction with the description of FIG. 6—to form a discrete accumulator chamber 68 for storing fuel. The accumulator chambers 68 are adjoined by a filter section 70 in which the bore is cylindrical with a smaller diameter than in the cylindrical region of the accumulator chamber 68. Between the cylindrical region of the accumulator chamber 68 and the filter chamber 70, the bore 54 has a conical section which is relatively short in the axial direction. The filter section 70 has arranged in it a filter 72 and a non-return valve with throttle passage 74 which will be described in more detail in conjunction with FIG. 5.

From the filter section 70 to the supply line connection 42, the bore 54 runs cylindrically and, as also shown in FIG. 5, with a diameter which is smaller again in relation to the filter section 70. Said smaller diameter corresponds at least approximately to the inner diameter of the high-pressure supply lines 44, 44'.

At the end at this side, the bore 54 widens conically so as to form a connection sealing surface 76 for the high-pressure supply line 44 or further high-pressure supply line 44'. The end of the high-pressure supply line 44 or further high-pressure supply line 44' is held in a known way against a connector-like projection of the accumulator housing 36 by means of a sleeve nut 78.

Figure 4:
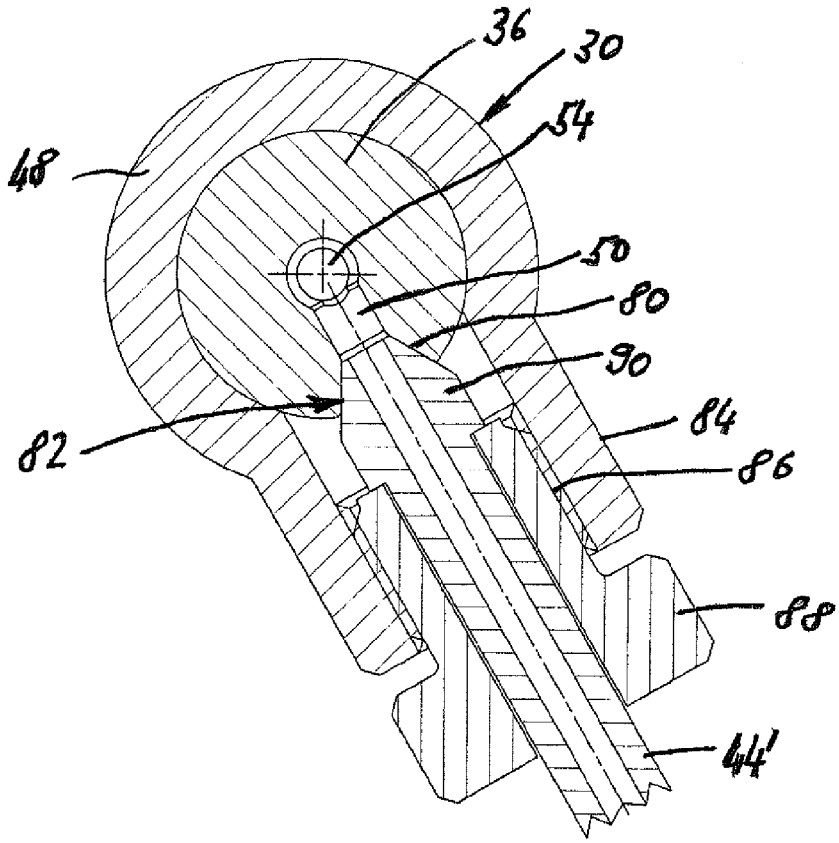
FIG. 4 shows a section along the line C-C in FIG. 3 through the accumulator housing and a clamp which engages around said accumulator housing.

As can be seen in particular from a juxtaposition of FIGS. 3 and 4, the connecting passage 50 branches off from the bore 54, in the radial direction, between the filter section 70 and the supply line connection 42. The connecting passage 50 widens conically in its radially outer half so as to form a sealing surface 80 of a guidance connection 82. The latter also has the clamp 48 which engages around the accumulator housing 36 and is provided with a threaded connector 84 which is formed in the radial direction and which has an internal thread 86. A pressure screw 88 interacts with the internal thread 86, through which pressure screw 88 the further high-pressure supply line 44' extends and which pressure screw 88 presses the sealing end section 90 of the further high-pressure supply line 44' sealingly against the sealing surface 80.

The volume of the discrete accumulator chamber 68 corresponds preferably to four to twenty times the volume of the fuel for an engine full load injection. At this juncture, it is also mentioned that the volume of the accumulator chamber 68 is also greater than, preferably two to three times as great as, the accumulator volume for fuel in the pressure pipe 34.

The design of the substantially cylindrical accumulator housing 36 with the bore 54 which widens in one direction or tapers in the other direction, and the formation of the guidance connection 82 with a clamp 48 which can be placed onto the accumulator housing 36, is extremely simple and permits the design of the accumulator chamber 68, the fixed connection to the pressure pipe 34 and the installation of further components which are described in conjunction with FIGS. 5 and 6.

As can be seen in particular from FIG. 5, the filter 72 which is inserted into the filter section 70 of the bore 54 is an edge-type filter 72' in the present case. Said edge-type filter 72' is of cylindrical design and has, distributed about its circumference, longitudinal grooves 92, 92' which are alternately open to the accumulator chamber 68 or to the supply line connection 42 but closed off at the other end and which overlap one another over a significant part of the length of the edge-type filter 72' as measured in the axial direction. The outer diameter of the edge-type filter 72' is slightly smaller in the region of said overlap than in the two axial end regions 94 and 94' which close off the longitudinal grooves 92 and 92' and by means of which the edge-type filter 72' is held in the filter section 72 of the bore 54 in the manner of an interference fit. The reduced diameter in the overlap region, together with the bore 54, delimits filter gaps 96 which allow the fuel to flow from the longitudinal grooves 92' into the longitudinal grooves 92 but retain solid particles.

Furthermore, the non-return valve 74 with throttle passage is arranged in the filter section 70 on the side facing away from the accumulator chamber 68. An annular, planar valve seat 98 of the non-return valve 74 is formed on the accumulator housing 36 by a shoulder 98' of the bore 54 at the supply-line-connection-side end of the filter section 70. A valve member plate 100', on which the throttle passage 102 is formed centrally, serves as a valve member 100. The valve member plate 100' is held, in such a way that it can be repelled, in contact against the valve seat 98 by means of a helical spring 104 which is supported at the other end against the edge-type filter 72'. That end of the edge-type filter 72' which faces toward the valve member plate 100' forms a stop 106 for the valve member plate 100' in order to limit the opening movement of the latter. The purpose and mode of operation of the non-return valve 74 with throttle passage 102, in conjunction with an at most small discrete accumulator chamber 68, is described in detail in WO 2007/009279 A. Firstly, a rapid flow of fuel into the accumulator chamber 68 and into the respective injection valve 10 is ensured, and secondly, the dynamic pressure waves from one injection process of the injection valve to the injection process of the next injection valve are dampened to such an extent that all the injection processes take place under practically identical conditions. For the sake of completeness, it is also mentioned here that the design of the accumulator chambers 68 and the interaction of the accumulator chambers 68 of the row of injection valves 10 is discussed in detail in said document.

Dashed lines in FIG. 5 illustrate a variant which is described further below.

The longitudinal bore 108 extending through the pressure pipe 34 in an axial direction—see in particular FIG. 6—is flared in its end region 108' facing toward the accumulator housing 36 in order to hold a flow-restricting valve 110. The seat 112 of said flow-restricting valve 110 is formed by a conical design of the longitudinal bore 108 at the transition from the cylindrical section of small diameter into the cylindrical end region 108' of relatively large diameter. A plunger 114 which acts as a valve member interacts with the seat 112, which plunger 114 is preloaded by means of a further helical spring 116 in the direction of the open position of the flow-restricting valve 110. In FIG. 6, the plunger 114 is shown in the open position. In the closed position, said plunger 114 engages into the seat 112 and prevents the further inflow of fuel to the associated injection valve 10.

On the side facing away from the seat 112, the plunger 114 bears, as a result of the force of the further helical spring 116, against a sleeve-shaped piston element 118 into which an aperture element 120 is inserted. The piston element 118 is arranged, and mounted so as to be movable in the direction of the longitudinal axis 32 in the pressure pipe 34, with a relatively close sliding fit 122 of for example 1/100 mm to 3/100 mm. The aperture element 120 is sealingly pressed into the piston element 118 and has an aperture passage 120' in the axial direction. At the end facing toward the piston element 118 and aperture element 120, the plunger 114 has radial bores 124 which run in a crossed fashion and which permit the through-flow of fuel from the accumulator chamber 68 and the aperture passage 120' to the associated injection valve 10.

The piston element 118 has, on its end side facing toward the plunger 114, a depression 126, with the aperture element 120 being arranged recessed in relation to said depression 126 and with said depression 126 serving to center the plunger 114 which engages therein with play. On the side facing away from the plunger 114, the piston element 118 has a further depression 126' so as to form an encircling stop bead 128 radially at the outside. Said stop bead 128 interacts with a stop disk 130 which, at the other side, is supported by means of an annular spring disk 132 against a support shoulder 134 of the accumulator housing 36. At the other side, the pressure pipe 34 bears with its end side at this end against the stop disk 130 and presses the latter against the annular spring disk 132. Recessed in relation to said end side, the pressure pipe 34 has on its radially outer side a sealing shoulder 136 against which a sealing ring 138 bears. At the other side, said sealing ring 138 bears against a counterpart sealing shoulder 140 of the accumulator housing 36. As the screw connection 38 between the accumulator housing 36 and the pressure pipe 34 is tightened, the sealing ring 138 is sealingly compressed.

The cross section of the aperture passage 120' is significantly smaller than all the other passages, encountered in the inflow direction to the injection valve 10, of the flow path for the fuel in the pressure connector 30. As a result, during normal injection processes, the piston element 118 moves together with the plunger 114 in the direction of the seat 112, but the plunger 114 does not come into contact with the seat 112 even during full-load injections. After the end of an injection process, the plunger 114 moves together with the piston element 118 in the direction of the stop disk 130 again, assisted by the force of the further helical spring 116.

However, if as a result of a defect downstream of the flow-restricting valve 110 the pressure drop across the piston element 118 and the aperture element 120 lasts for a longer time than during a full-load injection, the plunger 114 moves into the closed position and prevents the inflow of further fuel to the respective injection valve 10.

The installation of the flow-restricting valve 110, of the filter 72 and of the non-return valve 74 with throttle passage into the pressure connector 30 permits a simpler and space-saving design of the injection valves 10 otherwise fitted with said elements if appropriate. It is self-evidently also possible for the pressure connector 30 to be formed only with some or none of said elements. In any case, however, said pressure connector 30 has an accumulator chamber 68.

The two-part design of the housing of the pressure connector 30, specifically by means of a pressure pipe 34 and an accumulator housing 36, permits simple and cheap production of the pressure connector 30 with the integrated accumulator chamber 68 and if appropriate further elements—as discussed above. For the sake of completeness, it is mentioned that a part of the accumulator chamber 68 may also be formed on the pressure pipe 34.

It is also possible for the aperture element 120 to be integrally formed on the piston element 118. The separation of the piston element 118 and plunger 114 is advantageous in production terms in that little attention need be paid to the concentricity tolerances between firstly the outer lateral surface of the piston element 118 and the sealing surface of the plunger 114 and secondly the inner lateral surface of the pressure pipe 34 in the region of the sliding fit 122 and the seat 112.

In the variant of the device according to the invention indicated in FIG. 5 by dashed lines, the connection sealing surface 76 and the thread for the sleeve nut 78 are integrally formed on a substantially round cylindrical connection part 142 which, at the other side, is inserted into the bore 54, which is correspondingly widened in this region, of the accumulator housing 36 and is fastened to the latter by means of a screw connection 144. Between the threads for the sleeve nut 78 and the screw connection 144, the connection part 142 may have engagement surfaces, for example a hexagon, for a tool for tightening and loosening the further screw connection 144.

One section of the connecting passage 50 is formed on the connection part 142 and a further section is formed on the accumulator housing 36. To ensure the connection between said sections, the connection part 142 has a circumferential groove 146.

Between said circumferential groove 146 and the wide screw connection 144, sealing shoulders 148 are integrally formed on the connection part 142 and on the accumulator housing 36, which sealing shoulders 148 bear sealingly against one another.

That end side of the connection part 142 which faces toward the filter 72 forms the valve seat 98 for the valve member 100 or valve member plate 100'. Between said end side and the circumferential groove 146, either a sealing element or a relatively close fit is provided between the connection part 142 and the accumulator housing 36 in order to prevent or minimize leakage.

This variant which is shown has the advantage that the filter 72 or edge-type filter 72' can be inserted into the filter section 70 from the end of the accumulator housing 96 at this side. To position the filter 72 or edge-type filter 72', the accumulator housing 36 may have a stop bead 150 at the transition of the bore 54 from the filter section 70 into the accumulator chamber 68.

It is also conceivable for the accumulator housing 36 and the pressure pipe 34 to be formed together in one piece. In this case, the filter section 70 may have a diameter which corresponds to the diameter of the bore of the accumulator chamber 68 and the bore is closed off by means of a correspondingly simply matched connection part 142.

Furthermore, the illustrated and described embodiment of filter 72, non-return valve 74, flow-restricting valve 110 and connection part with supply line connection 42 and clamp 48, individually and in combination, is also suitable for use directly in injection valves 10. Here, the accumulator housing 36 and if appropriate pressure pipe 34 is replaced by the valve housing 22.

Figure 7:
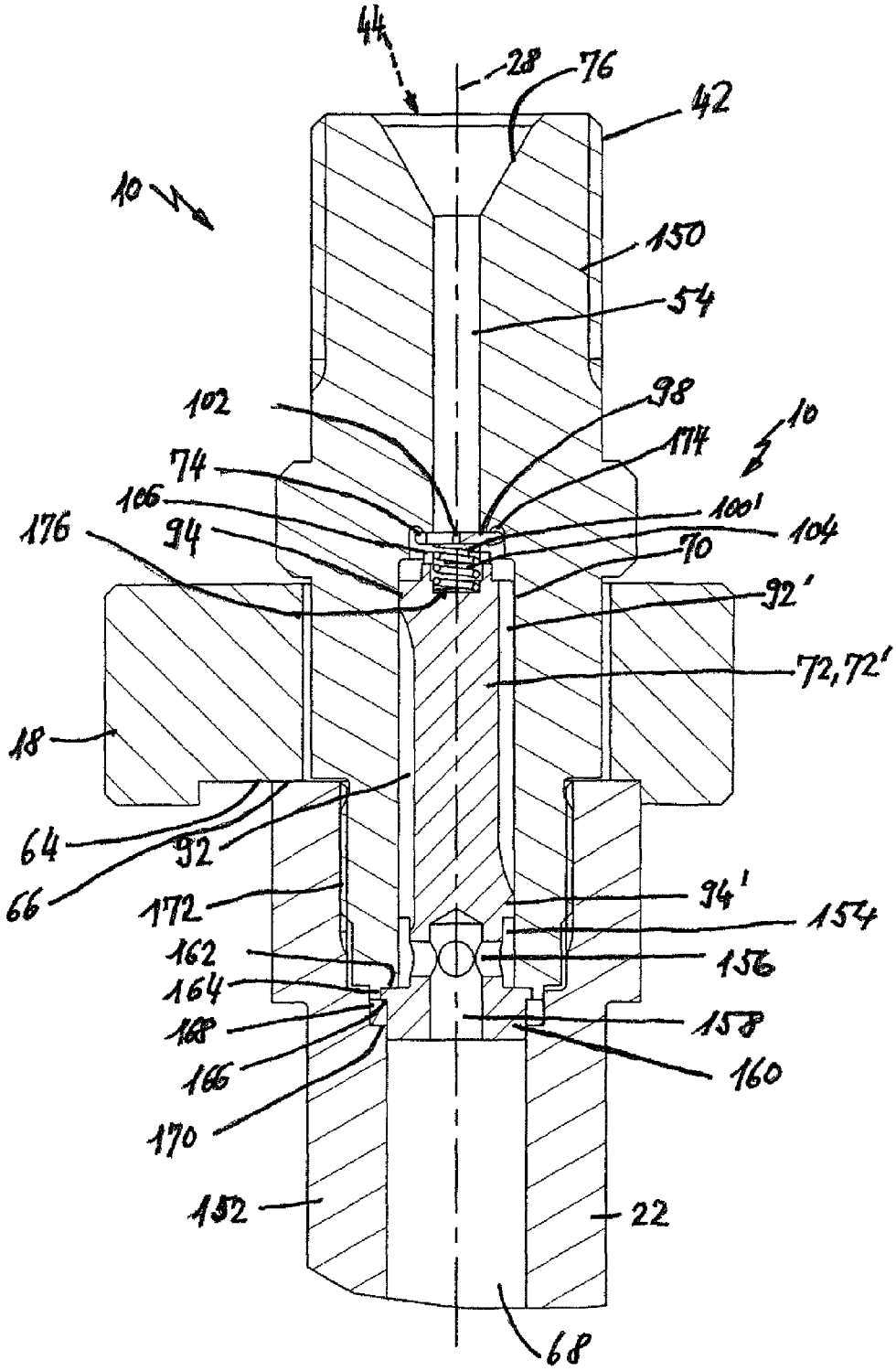
FIG. 7 shows a longitudinal section of a part of an injection valve housing of an injection valve with a connection piece in which the non-return valve and the edge-type filter are arranged.

FIG. 7 shows a part of an injection valve 10 in which the discrete accumulator chamber 68 is arranged in a known way in the valve housing 22 of the injection valve 10. In the embodiment shown, the housing body 152 of the valve housing 22 does not have a high-pressure sealing surface 24 for the pressure pipe 34 of a pressure connector 30, but rather the high-pressure supply line 44 is connected to the supply line connection 42 which is integrally formed on a connection piece 150 of the valve housing 22. Said connection piece 150 is screwed into the housing body 152 and, with regard to the connection sealing surface 76 and the supply line connection 42, is of identical design to the connection part 142 described further above and shown in FIG. 5.

Running through the connection piece 150 in the direction of the longitudinal axis 28 is the bore 54 with the filter section 70 and the adjoining bore section 54 which is smaller in cross section and which leads to the connection sealing surface 76. The filter section 70 opens out into the accumulator chamber 68 integrally formed on the housing body 152, with the filter 72 in the form of an edge-type filter 72' being inserted into the filter section 70 from the side facing toward the accumulator chamber 68. Said filter 72 has, as already described further above, the longitudinal grooves 92, 92', with the longitudinal grooves 92 being practically sealed off by means of the axial end region 94, which bears sealingly against the connection piece 150, in the direction of the non-return valve 74 and in the direction of the supply line connection 42 with a close fit. Correspondingly, the longitudinal grooves 92' which are open in the direction of the non-return valve 74 and in the direction of the supply line connection 42 are sealed off in the direction of the accumulator chamber 68 by the axial end region 94', as is also the case in the embodiments described further above. In the embodiment according to FIG. 7, however, the edge-type filter 72' has, in the axial end region 94' facing toward the accumulator chamber 68, a circumferential groove 154 which is open in the radially outward direction and which is flow-connected to the accumulator chamber 68 by means of radial bores 156, which run in a crossed fashion, and a blind-hole-like axial bore 158 which is open in the direction of the accumulator chamber 68.

While the longitudinal grooves 92 open out into the circumferential groove 154 and end there, the longitudinal grooves 92' are separated from said circumferential groove 154. For the sake of completeness, it is mentioned here that the circumferential groove 154 is covered radially at the outside by the connection piece 150.

That end region of the edge-type filter 72' which projects beyond the connection piece 150 in the direction of the accumulator chamber 68 is, so as to form a flange 160, of greater diameter than that part of the edge-type filter 72' which is arranged in the filter section 70. The flange 160 bears with its surface facing toward the connection piece 150 against an end-side counterpart shoulder 162 of the connection piece 150 and is engaged around by a sealing bead 164, which projects with respect to said connection piece 150 in the axial direction, of the connection piece 150. At the level of the free end of the sealing bead 164, the flange 160 has integrally formed on it a narrowing, which forms an encircling shoulder 166, of the outer diameter to the clear cross section of the accumulator chamber 68. The shoulder 166 and the free end of the sealing bead 164 bear against a seal ring 168 which bears at the other side against a sealing shoulder 170 of the housing body 152 and which is supported radially at the outside by the housing body 152 and radially at the inside by the flange 160. With its free end section, the flange 160 engages into the section, which forms the accumulator chamber 68, of the axial bore in the housing body 152. The seal ring 168, which preferably has a rectangular cross section, may be composed of a soft material and, when the screw connection 172 is tightened, is compressed between the connection piece 150 and the housing body 152 in order to ensure reliable sealing even at very high pressures.

The valve seat 98 for the valve member 100, which is designed as a valve member plate 100', of the non-return valve 74 is integrally formed on the connection piece 150. At the transition from the filter section 70 to that section of the bore 54 which leads to the connection sealing surface 76, the connection piece 150 has an encircling axial undercut 174 such that an annular bead which is exposed in the axial direction is formed with the annular valve seat 98.

The valve member plate 100' with the centrally arranged throttle passage 102 is held, in such a way that it can be repelled, in contact against the valve seat 98 by means of the helical spring 104, with the helical spring 104 being supported at the other end against the edge-type filter 72'. Said helical spring 104 engages into a centering recess 176 of the edge-type filter 72' at this end, which centering recess 176 has a sleeve-shaped projection which projects with respect to the axial end region 94 in the region of the valve member plate 100' and whose free end forms the stop 106 for limiting the opening travel of the valve member plate 100'.

The clamping bracket 18 engages with its pressure shoulder 64 on that end side of the housing body 152 which is situated at the connection piece 150 side and which forms the counterpart shoulder 66.

For the sake of completeness, it is mentioned that the injection valve 10 may also be designed as disclosed in WO 2007/009279 A. Furthermore, it is also possible for the connection piece 150 to be designed according to FIG. 4 for feeding a further injection valve 10. Moreover, it is mentioned that the pressure connector 30 may be designed analogously to FIG. 7. In the exemplary embodiment shown in FIG. 7, the edge-type filter 72' is held between the connection piece 150 and the seal ring 168. It is however also possible, as described further above, for the edge-type filter 72' to be fastened in the connection piece 150 by means of an interference fit.

Figure 8:
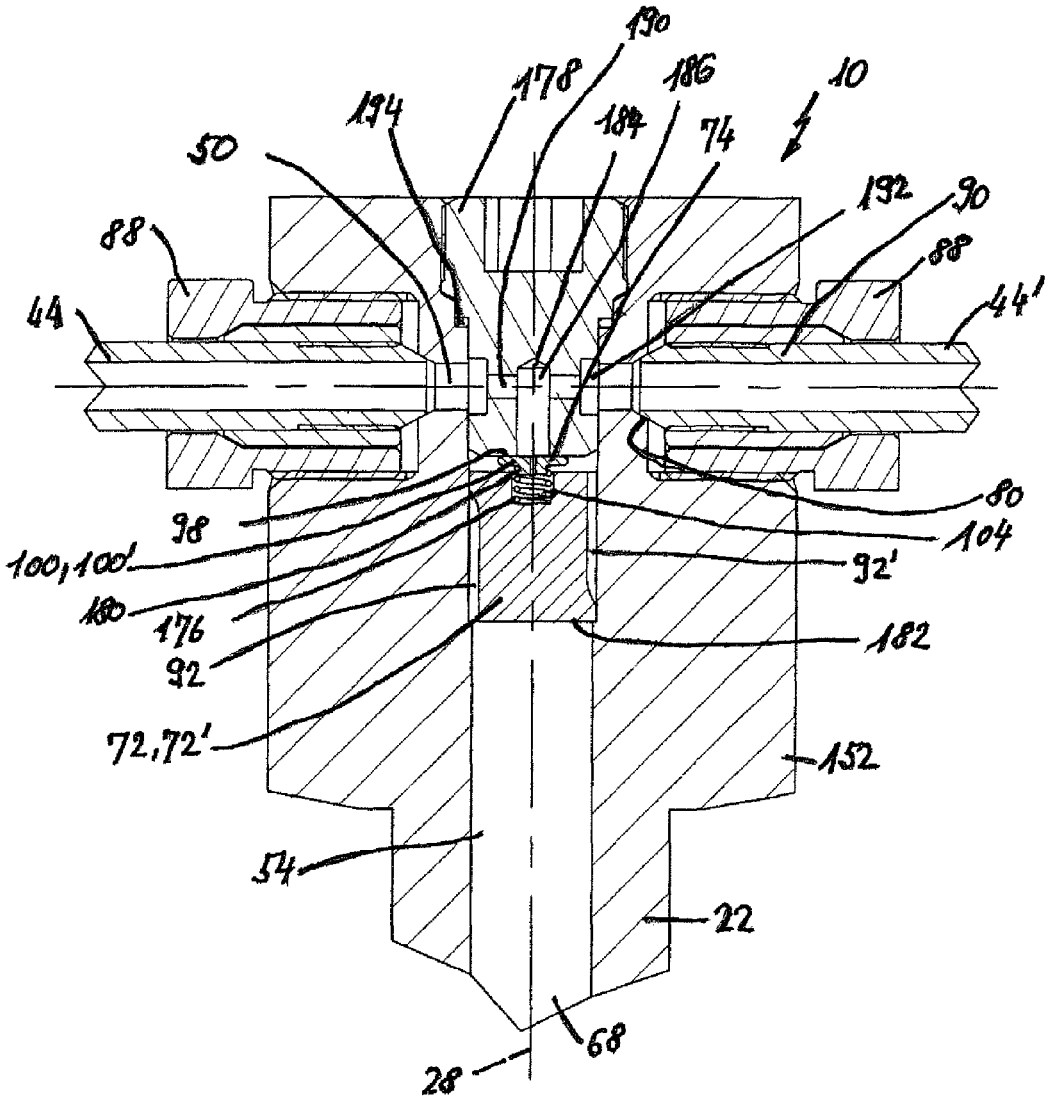
FIG. 8 shows, likewise in longitudinal section, a part of a further embodiment of the injection valve housing with a sealing plug on which the valve seat of the non-return valve is formed, and having an edge-type filter.

In the embodiment shown in FIG. 8, the discrete accumulator chamber 68 is likewise integrally formed on the housing body 152 of the injection valve 10. The bore 54 which runs in the direction of the longitudinal axis 28 and which forms the accumulator chamber 68 is sealed off at the connection-side end of the housing body 152 by means of a sealing plug 178, which is screwed into said housing body 152, of the valve housing 22. That end side of the sealing plug 78 which faces toward the accumulator chamber 68 forms the valve seat 98 for the valve member 100, which is designed as a valve member plate 100', of the non-return valve 74. Running centrally through the valve member plate 100' is the throttle passage 102. On the side facing away from the sealing plug 178, the valve member plate 100' has a cylindrical centering projection 180 which is engaged around by the end of the helical spring 104 at this side. Furthermore, said centering projection 180 engages into a centering recess 176 of the edge-type filter 72' which is inserted into the bore 54. That end side of the edge-type filter 72' which faces toward the valve member plate 100' forms the stop 106 for limiting the opening movement of the valve member plate 100'.

On the side facing away from the non-return valve 74, the edge-type filter 72' is supported in the axial direction on an encircling support shoulder 182. The edge-type filter 72' as per FIG. 8 is of substantially identical design to that according to FIGS. 3 and 5, wherein said edge-type filter 72' may however be designed to be shorter as viewed in the direction of the longitudinal axis 28 because it has approximately the same diameter as the accumulator chamber 68. Said edge-type filter 72' may therefore have more longitudinal grooves 92, 92' than the embodiment according to FIGS. 3 and 5 in order to form the same flow cross section in the narrow filter gaps between the edge-type filter 72' and the housing body 152. The edge-type filter 72' is held in the housing body 152 preferably by means of an interference fit.

The sealing plug 178 is provided with a fuel duct 184 which is connected at one side to the high-pressure supply line 44 and at the other side to the further high-pressure supply line 44' and leads to the non-return valve 74. Said fuel duct 184 is formed by a blind bore 186 which is engaged around by the annular valve seat 98, a radial bore 190 which intersects said blind bore 186, and an encircling connecting groove 192 which is outwardly open in the radial direction with respect to the longitudinal axis 28, in the base region of which connecting groove 192 the radial bore 190 opens out. For the sake of completeness, it is mentioned that, between the connecting groove 192 and that end side of the sealing plug 178 which faces toward the accumulator chamber 68, the sealing plug 178 is held in the housing body 152 with a relatively close fit in order to prevent or at least minimize leakage of fuel from the connecting groove 192 to the edge-type filter 72'. In the direction of the free end of the housing body 152, a seal 194 prevents the escape of fuel to the environment.

In the connecting groove 192, the connecting passage 50 runs through the housing body 152, which connecting passage 50 widens conically at both sides in the radially outward direction so as to form the sealing surfaces 80 with which the corresponding sealing surfaces 80 of the high-pressure supply line 44 and further high-pressure supply line 44' come into contact. The sealing end sections 90 of said high-pressure supply lines 44, 44' are held in sealing contact against the sealing surfaces 80 in a known way by means of pressure screws 88 which are screwed into the housing body 152.

Fuel supplied via the high-pressure supply line 44 to the injection valve 10 can therefore flow practically unhindered to the further high-pressure supply line 44' and can at the same time be supplied via the non-return valve 74 and the edge-type filter 72' to the accumulator chamber 68. The injection valve 10 may otherwise be designed for example as disclosed in WO 2007/009279 A. Furthermore, the embodiment shown in FIG. 8 may also be applied to the pressure connector 30.

Figure 9:
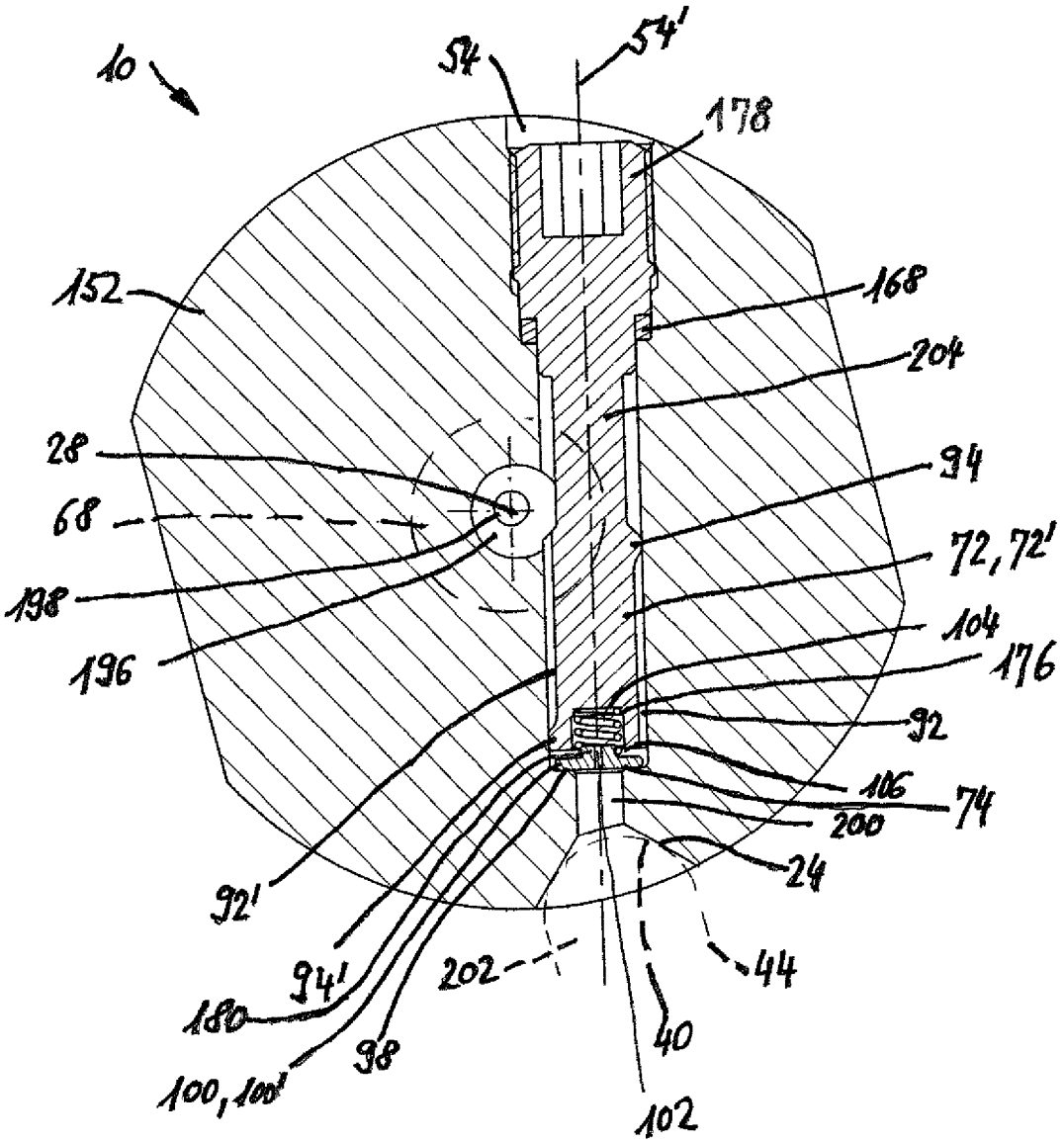
FIG. 9 shows a cross section through a housing body of an injection valve, with the edge-type filter being integrally formed on the sealing plug.

In the embodiment of the injection valve 10 shown in FIG. 9, too, the accumulator chamber 68 is integrally formed on the housing body 152 of the valve housing 22, with a connecting bore 196 running parallel to the longitudinal axis 28 and offset laterally with respect to the latter in the housing body 152 from said accumulator chamber 68 in the direction of the end facing away from the nozzle openings. The reference numeral 198 denotes the further connecting bore leading from the accumulator chamber 68 to the nozzle openings. The connecting bore 196 is either formed in the manner of a blind hole or is closed off by means of a plug.

The bore 54 runs through the housing body 152 at right angles to the longitudinal axis 28 and laterally offset with respect to the latter. Said bore 54 intersects the connecting bore 196 such that the bore 54 is flow-connected to the discrete accumulator chamber 68. The bore 54 could however also be arranged such that its axis 54' intersects the longitudinal axis 28.

The bore 54 is formed so as to narrow in a stepped fashion, with said bore 54 widening conically from its narrowest part, which forms an inflow section 200, in the outward direction so as to form a high-pressure sealing surface 24. A pressure pipe connector 202 bears by means of its high-pressure counterpart sealing surface 40 against said high-pressure sealing surface 24. The pressure pipe connector 202 is of generally known design and, in the present case, does not have a discrete accumulator chamber 68. Said pressure pipe connector 202 may however fundamentally be provided and constructed with an accumulator chamber of said type, as described further above.

At the other end, the bore 54 is sealingly closed off by means of a sealing plug 178 which is screwed into the housing body 152. For this purpose, a seal ring 168 acts between the sealing plug 178 and the housing body 152.

The edge-type filter 72' is integrally formed on a plug shank 204 which projects from and is formed in one piece with the sealing plug 178, which edge-type filter 72' is otherwise of exactly the same design as described further above and shown for example in FIGS. 3 and 5. Here, too, the longitudinal grooves 92 are open in the direction of the non-return valve 74 and therefore in the direction of the fuel-conducting pressure pipe connector 202 and are closed off at the other side by means of the axial end region 94, with the latter bearing sealingly against the housing body 152 upstream of the flow connection to the connecting bore 196 as viewed in the inflow direction of the fuel. Correspondingly, the longitudinal grooves 92' running through the axial end region 94 are closed off upstream by the axial end region 94'.

Between the axial end region 94 and the sealing plug 178, the plug shank 204 is provided with a reduced cross section in order to produce an adequate flow cross section to the connecting bore 196.

That end side of the edge-type filter 72' which faces toward the inflow section 200 forms the stop 106 for the valve member 100, which is designed as a valve member plate 100', of the non-return valve 74. Said valve member 100 has, on its side facing toward the edge-type filter 72, the centering projection 180 which is engaged around by the end of the helical spring 104 at this side, with said helical spring 104 engaging into the centering recess 176 of the edge-type filter 72' and being supported against the base of said centering recess 176. The helical spring 104 holds the valve member plate 100', in such a way that it can be repelled, in contact against the valve seat 98 which is formed by a step-like narrowing of the bore 54. Here, too, the central throttle passage 102 through the valve member plate 100' permanently connects the high-pressure supply line 44 to the accumulator chamber 68 even in the closed position of the non-return valve 74. Here, too, the injection valve 10 may otherwise be designed correspondingly to WO 2007/009279 A.

The mode of operation and action of the non-return valve 74 with bypass throttle is the same in all the embodiments and is as described further above.

The invention claimed is:

1. A device for injecting highly pressurized fuel into a combustion chamber of an internal combustion engine, comprising:

an injection valve;

a discrete accumulator chamber for the fuel, the discrete accumulator chamber being arranged in a housing being connected to a high-pressure supply line and being assigned to the injection valve;

a non-return valve arranged in the housing and acting between the discrete accumulator chamber and the high-pressure supply line;

the non-return valve having a valve member interacting with a valve seat and having a throttle passage for the fuel;

the non-return valve ensuring rapid flow of fuel into the discrete accumulator chamber and the injection valve and the non-return valve damping the dynamic pressure waves from the injection process of the injection valve to the injection process of a next injection valve to such an extent that all the injection processes take place under practically identical conditions;

a filter for the fuel arranged in the housing; and the filter forming a stop for limiting the open movement of the valve member.

2. The device as claimed in claim 1, wherein the filter has an edge-type filter which forms the stop.

3. The device as claimed in claim 1, wherein the valve member is designed as a valve member plate with the throttle passage.

4. The device as claimed in claim 1, wherein the valve seat is integrally formed on the housing.

5. The device as claimed in claim 1, wherein the injection valve has a valve housing with a high-pressure sealing surface which points toward the outside and which surrounds a fuel inlet opening of the valve housing, a pressure connector for conducting fuel to the fuel inlet opening has an accumulator housing which delimits the discrete accumulator chamber for the fuel, which accumulator housing is at one side connected to the high-pressure supply line and at the other side has a pressure pipe which bears, by means of a high-pressure counterpart sealing surface formed in a free end region, against the high-pressure sealing surface, and a clamping device for pressing the high-pressure counterpart sealing surface sealingly against the high-pressure sealing surface engages on the pressure pipe.

6. The device as claimed in claim 5, wherein the pressure pipe is fastened to the accumulator housing by means of a screw connection.

7. The device as claimed in claim 1, the injection valve has an injection valve housing in which the accumulator chamber, the non-return valve and the filter are arranged.

8. The device as claimed in claim 7, wherein the injection valve housing has a housing body, which delimits the accumulator chamber, and a connection piece which is arranged on said housing body and which is connected to the high-pressure supply line, in which connection piece the non-return valve and the filter are arranged and on which connection piece the valve seat is preferably integrally formed.

9. The device as claimed in claim 7, wherein the injection valve housing has a housing body which delimits the accumulator chamber and a sealing plug which is arranged on said housing body, on which sealing plug the valve seat is integrally formed.

10. The device as claimed in claim 9, wherein the sealing plug has a fuel duct which leads to the non-return valve and which is connected at one side to the high-pressure supply line and at the other side to a further high-pressure supply line which leads to a further injection valve.

11. The device as claimed in claim 9, wherein the housing body has an outwardly pointing high-pressure sealing surface which surrounds a fuel inlet opening of the housing body, a pressure pipe connector which is connected at one side to the high-pressure supply line and which serves for supplying fuel to the fuel inlet opening bears at the other side, by means of a high-pressure counterpart sealing surface formed in a free end region, against the high-pressure sealing surface, and furthermore, the filter is integrally formed on the sealing plug.

12. The device as claimed in claim 1, wherein a flow-restricting valve for the fuel is arranged in the housing.

13. The device as claimed in claim 12, wherein the flow-restricting valve has a plunger, which is designed for interacting with a seat, and a piston element against which the plunger, by means of its side facing away from the seat, bears in spring-loaded fashion.

14. A device for injecting highly pressurized fuel into a combustion engine of an internal combustion engine, having comprising:

an injection valve;

a discrete accumulator chamber for the fuel, the discrete accumulator chamber being arranged in a housing and being assigned to the injection valve, the discrete accumulator chamber being connected by means of a supply line connection of the housing to a high-pressure supply line; and a clamp;

wherein the housing is engaged around by the clamp by means of which a further high-pressure supply line is connected to the housing, wherein the housing has a connecting passage leading to the further high-pressure supply line, and wherein the further high-pressure supply line serves to feed a further injection valve.

15. A device for injecting highly pressurized fuel into a combustion chamber of an internal combustion engine, comprising:

an injection valve;

a discrete accumulator chamber being arranged in a housing being connected to a high-pressure supply line and being assigned to the injection valve;

a flow-restricting valve for the fuel, the flow-restricting valve having a plunger and a piston element with an associated aperture passage, and the plunger being designed for interacting with a seat; and a plunger bearing with its side facing away from the seat in spring-loaded fashion against the piston element, wherein during normal injection the piston element moves together with the plunger in the direction of the seat without coming into contact with the seat, and wherein as a result of a defect downstream of the flow-restricting valve the plunger moves into contact with the seat and thereby prevents the inflow of further fuel into the injection valve.

* * * * *